US007861412B2

(12) United States Patent
Imamura et al.

(10) Patent No.: US 7,861,412 B2
(45) Date of Patent: Jan. 4, 2011

(54) METHOD FOR MOLDING VEHICULAR WHEEL RIM

(75) Inventors: Yoshihaya Imamura, Fujisawa (JP); Junichi Sato, Kaga (JP); Daigo Masumoto, Kaga (JP); Katsuhiro Motode, Kaga (JP)

(73) Assignee: Daido Kogyo Co., Ltd., Ishikawa Pref. (JP)

( * ) Notice: Subject to any disclaimer, the term of this patent is extended or adjusted under 35 U.S.C. 154(b) by 1043 days.

(21) Appl. No.: 11/645,032

(22) Filed: Dec. 26, 2006

(65) Prior Publication Data

US 2007/0143988 A1 Jun. 28, 2007

(30) Foreign Application Priority Data

Dec. 27, 2005 (JP) ..... 2005-376441

(51) Int. Cl.

| | |
|---|---|
| ***B21F 43/00*** | (2006.01) |
| ***B23P 13/04*** | (2006.01) |
| ***A61C 5/02*** | (2006.01) |
| ***A61C 3/08*** | (2006.01) |

(52) U.S. Cl. ..... 29/894.35; 29/419.2; 29/523; 29/890.044; 29/894.354; 72/56; 72/370.07

(58) Field of Classification Search ..... 29/419.2, 29/523, 890.044, 894.35, 894.354; 72/56, 72/370.07

See application file for complete search history.

(56) References Cited

U.S. PATENT DOCUMENTS

| | | | | |
|---|---|---|---|---|
| 3,779,060 | A * | 12/1973 | Schroder | 72/87 |
| 4,408,379 | A * | 10/1983 | Kusano et al. | 29/894.353 |
| 4,545,419 | A * | 10/1985 | Zulauf | 164/111 |
| 5,826,320 | A * | 10/1998 | Rathke et al. | 29/419.2 |
| 6,587,185 | B1 * | 7/2003 | Ide et al. | 356/5.01 |
| 7,441,335 | B2 * | 10/2008 | Imamura et al. | 29/894.35 |

* cited by examiner

*Primary Examiner*—David P Bryant
*Assistant Examiner*—Alexander P Taousakis
(74) *Attorney, Agent, or Firm*—Wenderoth, Lind & Ponack, L.L.P.

(57) ABSTRACT

A method prevents a cylindrical body from buckling in externally curling edges of both side portions by pressing curling dies in an axial direction after molding the cylindrical body having a drop portion whose outer diameter is small and two side portions whose outer diameter is large by enlarging a cylindrical material made of aluminum alloy by electromagnetic molding. In curling the edges of the side portions, a buckling preventing die restrains an outer periphery of the drop portion of the cylindrical body. Because the buckling preventing die receives the axial compression force of the curling dies, it can prevent the cylindrical body from buckling and deforming. The buckling preventing die is what a split die disposed on the side of an outer periphery of the cylindrical material in the electromagnetic molding is used as.

4 Claims, 5 Drawing Sheets

METHOD FOR MOLDING VEHICULAR WHEEL RIM

BACKGROUND OF THE INVENTION

1. Field of the Invention

The present invention relates to a method for molding a vehicular wheel rim made of a metal plate or protruded member.

2. Related Art

Japanese Patent Laid-Open No. 2005-95982 Gazette (US2005091850A1) describes a method for manufacturing a wheel for use in passenger cars, trucks, buggies and the like. It then discloses a method for molding a wheel rim by disposing an electromagnetic molding die whose inner face serves as a molding face at an outer peripheral side of a cylindrical material made of aluminum alloy, disposing an electromagnetic molding coil at an inner peripheral side of the cylindrical material, charging electrical energy to the electromagnetic molding coil in this state to enlarge and press the cylindrical material against the molding face of the molding die to mold a cylindrical body having a drop portion whose outer diameter is small and both side portions whose outer diameter is larger than that of the drop portion and by curling edges of the side portions.

It is noted that the electromagnetic molding refers to a technology of molding a workpiece into a predetermined shape by making use of a phenomenon in which an electromagnetic molding coil produces a strong magnetic field in a very short time when electric energy (electric charge) accumulated at high voltage is instantaneously charged (discharged) into the electromagnetic molding coil and the workpiece placed in the magnetic field is subjected to a strong enlarging force or contraction force caused by a repulsive force (Lorentz force according to Fleming's left-hand rule) of the magnetic field and thereby undergoes fast plastic deformation. In case of this example, the cylindrical material enlarges in a direction of the outer diameter by receiving the strong enlarging force and is pressed against the molding face of the electromagnetic molding die.

Because an extruded member having an equal thickness or a plate member in a cylindrical shape formed by bending and welding edge portions thereof is used as the cylindrical material and the side portions are enlarged more than the drop portion, the above-mentioned method allows the wheel rim having the thicker drop portion (thickness decreases less in enlarging the diameter thereof) and the thinner both side portions (thickness decreases more in enlarging the diameter) to be molded. Therefore, when a disk is fixed to the drop portion, the wheel rim hardly causes welding distortion and can support a large load corresponding to its thickness. Still more, if the thickness of the drop portion is supposed to be equal, weight of the entire wheel rim may be lightened due to the thin both side portions. It should be noted that Japanese Patent Laid-Open No. 2004-224292 Gazette also describes a curling of edges of the wheel rim.

However, there has been a problem in pressing a curling die against the edges of the side portions to bend and curl the edges in an external direction (external curling process) in a curling process after the electromagnetic molding that the drop portion of the cylindrical body buckles due to the pressure in the axial direction of the curling die.

Accordingly, it is an object of the invention to solve the above-mentioned problem in molding the wheel rim from the cylindrical material by applying the electromagnetic molding method and the curling method by pressing.

SUMMARY OF THE INVENTION

According to the invention, there is provided a method for molding a vehicular wheel rim by disposing an electromagnetic molding die whose inner face serves as a molding face on the side of an outer periphery of a metallic cylindrical material, disposing an electromagnetic molding coil on the side of an inner periphery of the cylindrical material, charging electrical energy to the electromagnetic molding coil in this state to enlarge and press the cylindrical material against the molding face of the molding die to mold a cylindrical body having a drop portion whose outer diameter is small and both side portions whose outer diameter is larger than that of the drop portion and by externally curling edges of the side portions by pressing by curling dies in the axial direction while restraining the outer periphery of the drop portion of the cylindrical body by a buckling preventing die.

An extruded material having an equal thickness or a plate material in a cylindrical shape obtained by bending and welding end portions thereof may be used as the cylindrical material. It is preferable to use aluminum (including aluminum alloy), copper (including copper alloy) and the like having a high electrical conductivity, and it is particularly preferable to use aluminum (including aluminum alloy).

A die having molding faces in the shapes corresponding to the drop portion and the side portions of the cylindrical body after molding may be used as the electromagnetic molding die. Beside that, an electromagnetic molding die having no molding face corresponding to part of or an entirety both side portions and having a molding face whose axial length is short as compared to an axial length of the cylindrical body to be molded, i.e., whose inner peripheral face is composed of the molding face in the shape corresponding to the drop portion of the cylindrical body or whose inner peripheral face is composed of the molding face in the shape corresponding to the drop portion and to part of the side portions of the cylindrical body.

The external curling process by pressing is carried out in a manner of pressing curling dies against edges of the side portions. A known arc-like tool (a semi-arc or a quarter-arc tool) or a cone-like tool may be used as the curling die.

The buckling preventing die has an inner peripheral face corresponding at least to the drop portion of the cylindrical body. Still more, the side portions that are subject to the curling process must be exposed out of the die so that the die will not hamper the curling process. Although a dedicated die may be used as the buckling preventing die, the electromagnetic molding die used in the electromagnetic molding step may be used as it is.

A roll-forming process is carried out as necessary after the curling process. The roll-forming process is a processing method carried out by pinching inner and outer sides of the cylindrical body by rollers and is used in finishing a sectional shape of the cylindrical body into a final shape of the wheel rim.

The invention allows the wheel rim to be molded efficiently from the cylindrical material by successively applying the electromagnetic molding step and the curling step and prevents the buckling from occurring at the drop portion of the cylindrical body by restraining the outer periphery of the drop portion by the buckling preventing die in the curling step carried out by pressing. Then, as for the cylindrical material having the equal thickness, while the thickness is kept relatively thick at the drop portion, it is thin at the side portions by the enlargement of the electromagnetic molding step. The thin both side portions may be readily curled by relatively low compression force in the axial direction, allowing the vehicular wheel rim to be manufactured at high precision in combination with the restraint of the outer periphery of the drop portion by the buckling preventing fixture.

Still more, when the electromagnetic molding die is used as the buckling preventing die, it becomes possible to cut the equipment costs and to simplify the molding steps because it is not necessary to replace the electromagnetic molding die with the buckling preventing die.

The wheel rim manufactured by the manufacturing method of the invention has the thick drop portion that junctions with the disk and the relatively thin both side portions, so that it becomes possible to lighten its weight, even though it bears the large load, and to cut the number of processing steps and to improve product performance because the rim has no junction. Further, because the disk is fixed to the drop portion by welding or the like, it becomes possible to design the disk solely and to have an excellent decorative design. Still more, it allows highly accurate products to be obtained.

It is noted that the summary of the invention described above does not necessarily describe all necessary features of the invention. The invention may also be a sub-combination of the features described above.

DETAILED DESCRIPTION OF THE INVENTION

The invention will be explained below more specifically with reference to FIGS. 1 through 5. The invention will be explained below based on a preferred embodiment, which does not intend to limit the scope of the invention, but exemplify the invention. All of the features and the combinations thereof described in the embodiment are not necessarily essential to the invention.

Figure 1:
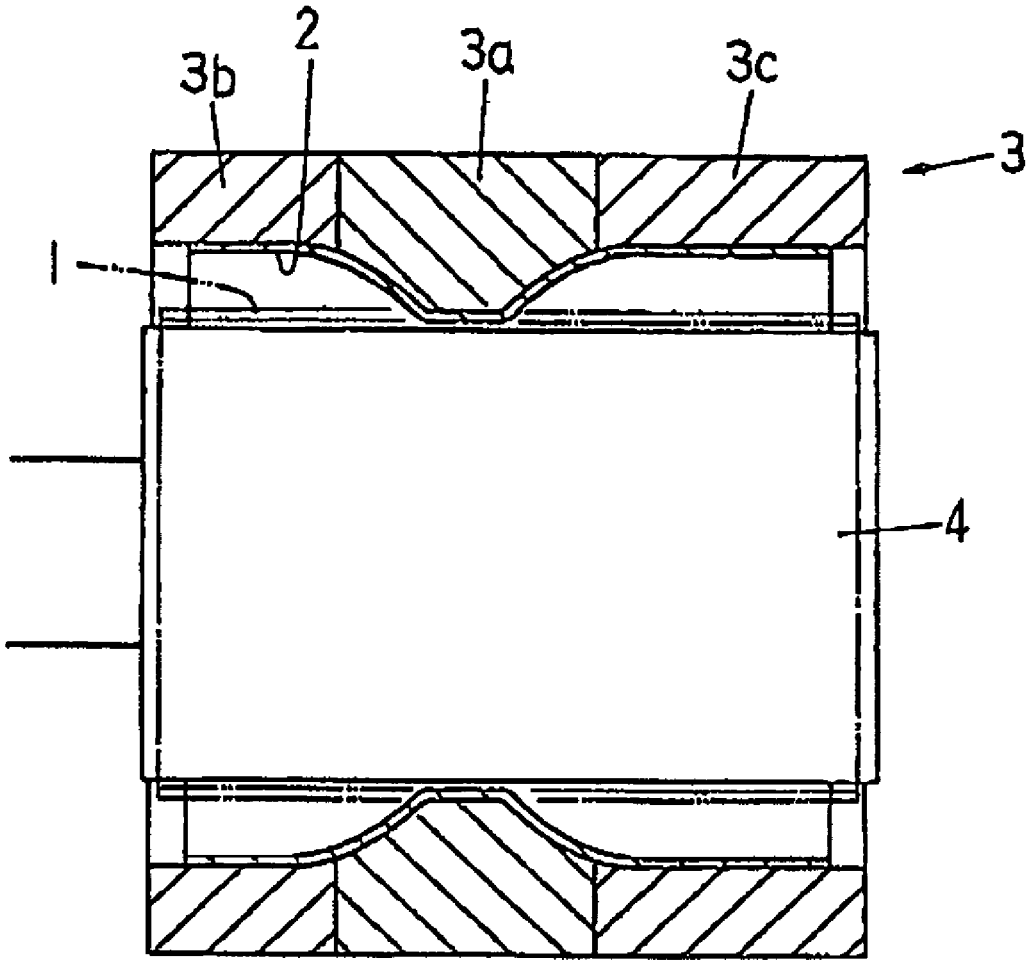
FIG. 1 is a section view for explaining a step of electromagnetically molding a cylindrical material.
Figure 2:
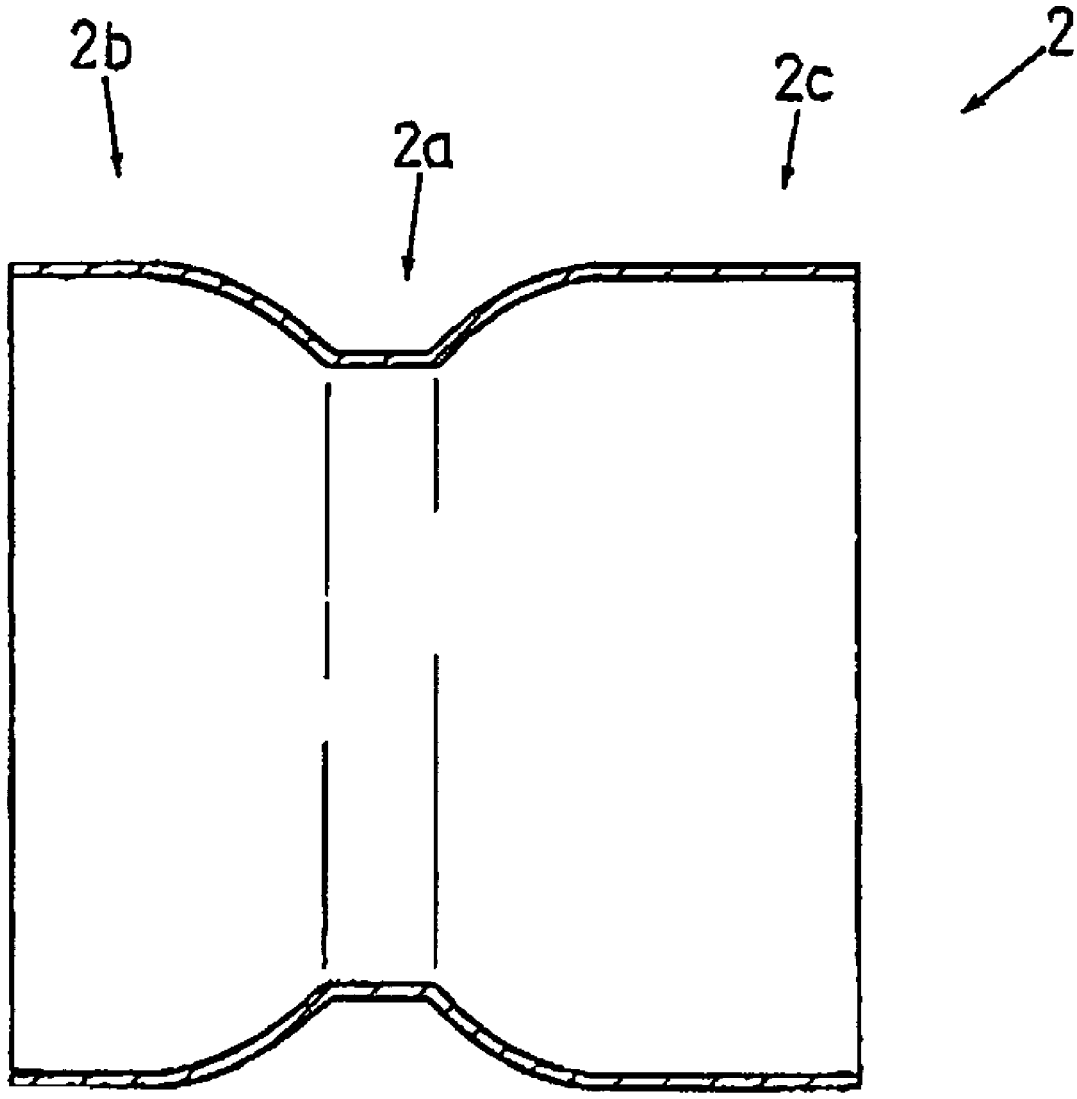
FIG. 2 is a section view of the electromagnetically molded cylindrical body.

FIG. 1 shows an electromagnetic molding step of molding a cylindrical body 2 (see FIG. 2) having a drop portion 2*a* whose outer diameter is small and both side portions 2*b* and 2*c* whose outer diameter is larger than that of the drop portion 2*a* by enlarging a cylindrical material 1 indicated by imaginary lines by means of an electromagnetic molding method.

The cylindrical material 1 is an extruded member made of aluminum alloy having a circular section and an equal thickness. An electromagnetic molding die 3 whose inner face serves as a molding face is disposed on the side of an outer periphery of the cylindrical material 1 and an electromagnetic molding coil 4 is disposed on the side of an inner periphery of the cylindrical material 1. Center axes of the cylindrical material 1, the electromagnetic molding die 3 and the electromagnetic molding coil 4 almost coincide from each other. The electromagnetic molding die 3 is composed of three split dies 3*a*, 3*b* and 3*c* split in a longitudinal direction as shown in FIG. 1. The center split die 3*a* corresponds to the drop portion 2*a* of the cylindrical body 2 and the split dies 3*b* and 3*c* on both sides have inner peripheral faces in the shapes (molding faces) corresponding to the side portions 2*b* and 2*c* of the cylindrical body 2. Each of the split dies 3*a* through 3*c* may be divided into two pieces in a radial direction.

In the electromagnetic molding die 3, a center part of the molding face of the split die 3*a* corresponding to the drop portion 2*a* of the cylindrical body 2 is cylindrical and has a smallest inner diameter and both sides thereof have an inner diameter that gradually increases toward the outsides (toward the split die 3*b* and 3*c*). The molding faces of the split dies 3*b* and 3*c* corresponding to the side portions 2*b* and 2*c* of the cylindrical body 2 have an inner diameter that gradually increases only at parts close to the split die 3*a* and is almost cylindrical other than that. There is a slight gap between the outer peripheral face of the cylindrical material 1 and the molding face of the split die 3*a* at the center part of the molding face of the split die 3*a*. There is also a gap of adequate size between the inner peripheral face of the cylindrical material 1 and the electromagnetic molding coil 4.

It should be noted that preferably the electromagnetic molding die 3 is made of a metal having a low electrical conductivity such as stainless steel. If it is not used as a buckling preventing die as described later, a material other than the metal such as a structural material having no electrical conductivity such as fiber reinforced plastic and bakelite for example may be used for the electromagnetic molding die 3. The electromagnetic molding coil 4 is what a molding coil is embedded within an electrical insulator.

A moldable material having a high electrical conductivity such as O material (modification: annealing) of aluminum alloy of JIS 6000 such as 6063, 6061 and 6N01 is preferable as the material of the cylindrical material 1. When the cylindrical material 1 is placed within the electromagnetic molding die 3 and the electromagnetic molding coil 4 is inserted into the cylindrical material 1 as indicated by the imaginary lines in FIG. 1 and when electrical energy is charged to the electromagnetic molding coil 4, the cylindrical material 1 causes magnetic repulsion force, and instantly enlarges and hits against the molding face of the die 3. It is then molded into the shape corresponding to the molding faces and becomes the cylindrical body 2 having the drop portion 2*a* whose outer diameter is small and the side portions 2*a* and 2*b* whose outer diameters are large (see FIG. 2). Because the rate of enlargement is close to zero at the center part of the drop portion 2*a*, increases on the sides closer to the outside and becomes largest on the side portions 2*b* and 2*c*, the thickness of the side portions 2*b* and 2*c* is thin as compared to the drop portion 2*a* (specifically to the center part thereof).

After the electromagnetic molding, the split dies 3*b* and 3*c* are split and are removed, the electromagnetic molding coil 4 is pulled out and an external curling process by pressing is carried out on edges of the side portions 2*b* and 2*c* of the cylindrical body 2 (curling step).

Figure 3:
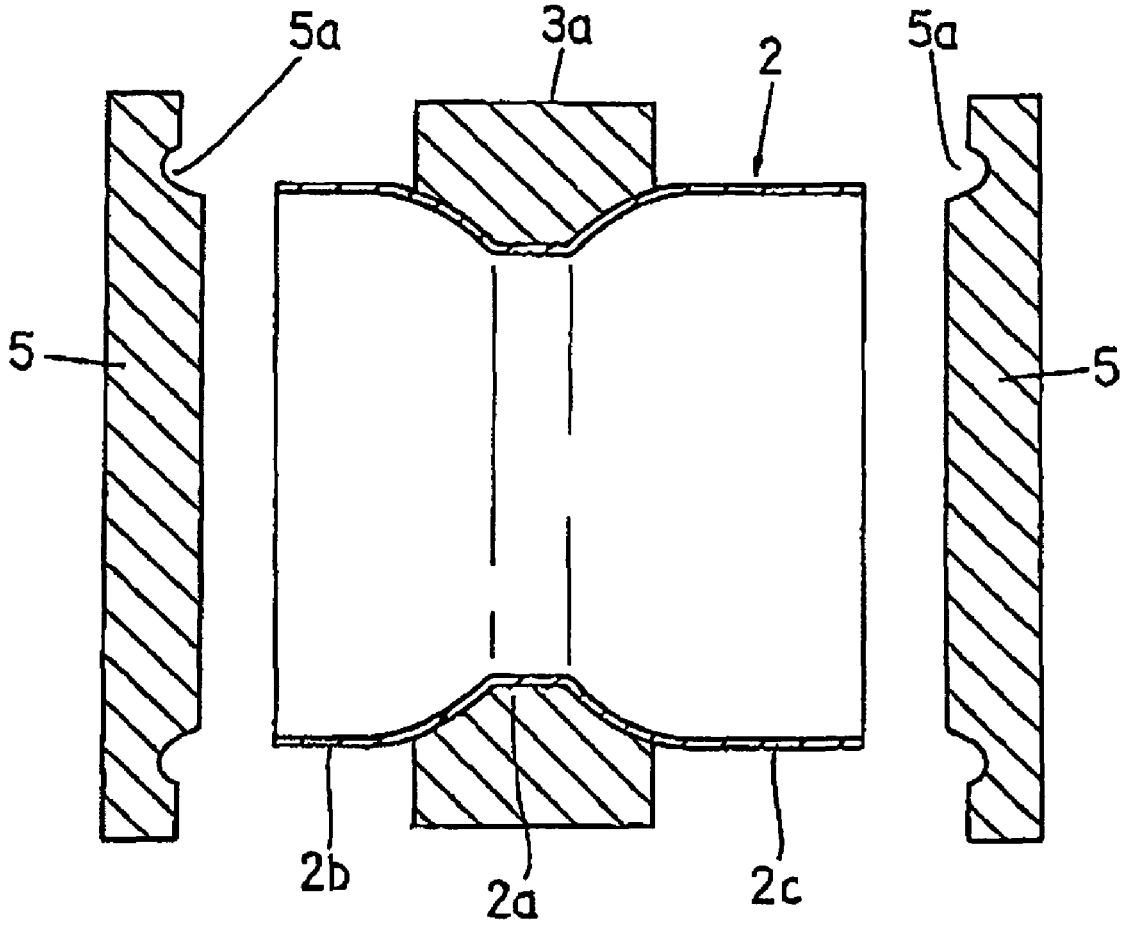
FIG. 3 is a section view for explaining a step of curling the cylindrical material.

FIG. 3 explains the curling step, wherein the split die 3*a* that is a part of the electromagnetic molding die 3 is continuously disposed around the cylindrical body 2 in a manner of restraining the outer periphery of the drop portion 2*a*. The split die 3*a* corresponds to the buckling preventing die of the invention.

Figure 4:
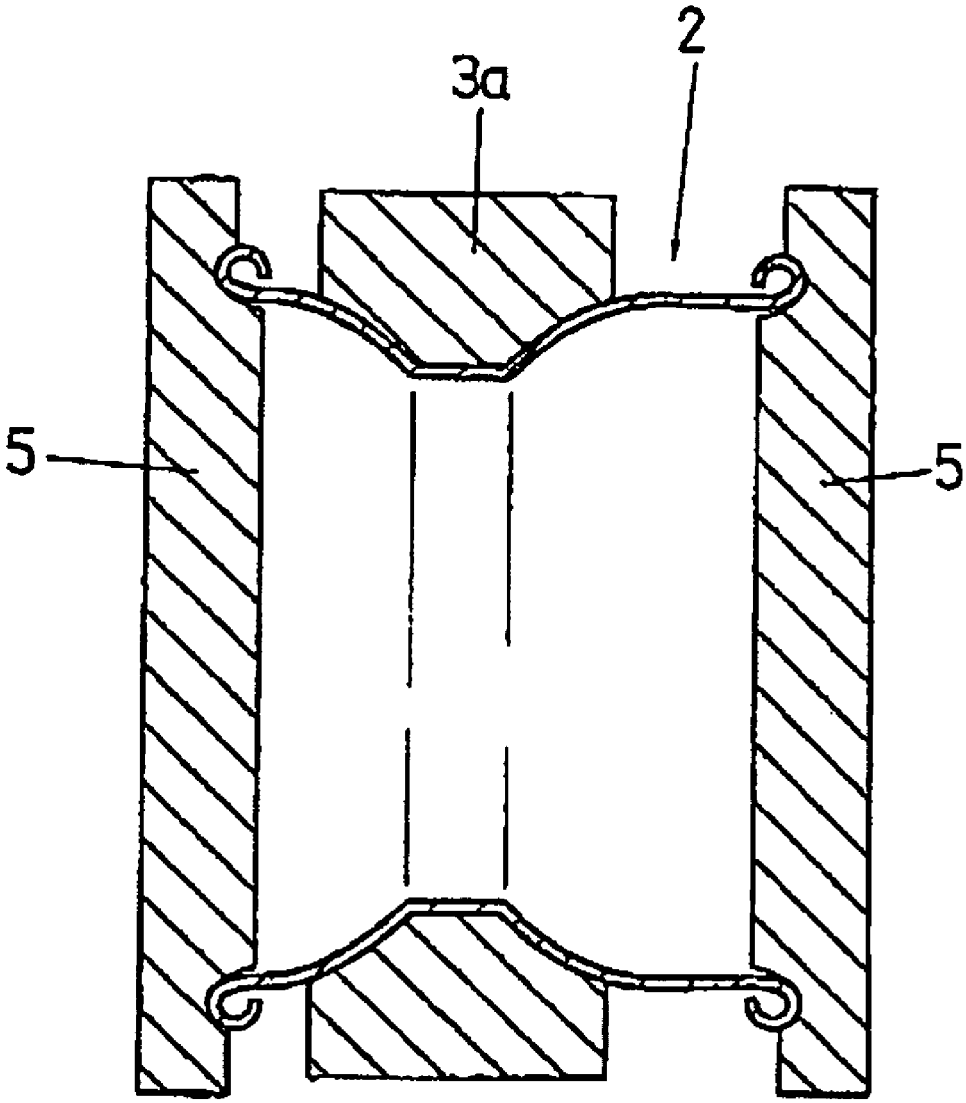
FIG. 4 is another section view for explaining the step of curling the cylindrical material.

When curling dies 5 that are well-known per se are advanced in the same time and pressed against the edges of the side portions 2*b* and 2*c* of the cylindrical body 2, the edges cause external curling deformation along almost semi-circular grooves 5*a* as shown in FIG. 4. Because the cylindrical body 2 is axially compressed by strong pressure of the press, the cylindrical body 2 normally tends to cause buckling deformation at the drop portion 2*a*. However, because the split die

3*a* restrains the outer periphery of the drop portion 2*a* and receives the pressure of the axial compression, it can prevent the buckling deformation.

Figure 5:
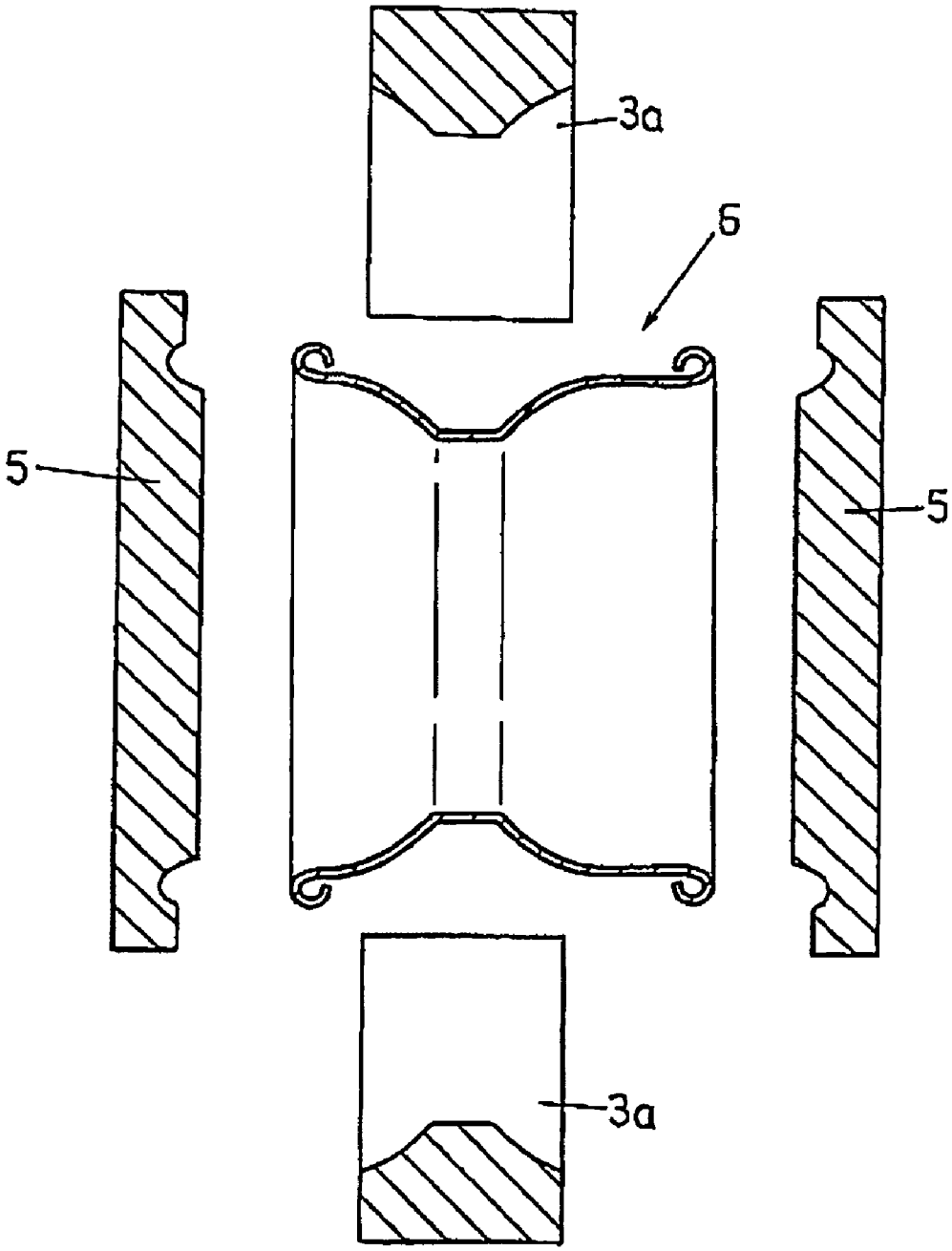
FIG. 5 is a still other section view for explaining the step of curling the cylindrical material.

After the curling process, it becomes possible to obtain a cylindrical body (wheel rim) 6 by moving back the curling dies 5 and splitting and removing the split die 3*a* as shown in FIG. 5. A rolling process may be implemented on the cylindrical body 6 as necessary to produce as a wheel rim product.

It should be noted that although the electromagnetic molding die 3 (3*a* through 3*c*) that covers the entire length of the cylindrical material 1 has been used in the electromagnetic molding step in the example described above, it is also possible to adopt a method of disposing only the electromagnetic molding die (i.e., the split die 3*a*) that covers not the entire length but a range corresponding to the drop portion 2*a* of the cylindrical body 2 for example around the cylindrical material 1 to mold the drop portion 2*a* into the shape corresponding to the molding face of the die and of freely deforming the side portions corresponding to the electromagnetic molding force.

Still more, although the split die 3*a* composing the electromagnetic molding die 3 is used as the buckling preventing die in the curling step in the example described above, it is also possible to use a dedicated buckling preventing die separately.

EMBODIMENT (1) Standard Name: Wheel Rim specified by JATMA (Japan Automobile Tyre Manufacturers Association)

(2) Nominal Size of Rim: 10×5.5 AT (3) Material: A6063-O material (4) Workpiece: Cylindrical material molded by extrusion molding
Outer Diameter: (ϕ198.8 [mm]
Thickness (plate thickness): 2.5 [mm]

(5) State of Cylindrical Body caused by Electromagnetic Molding Step
Diameter of Edge of Enlarged Tube (both side portions): (ϕ250 [mm]
Thickness of Edge of Enlarged Tube: 2.1 [mm]
Rate of Enlargement of Tube: about 25%

(6) Processing Conditions in Curling Step
Example 1: Maximum Load 95 [KN]
Machining Speed 20 [mm/min.]
Example 2: Maximum Load 100 [KN]
Machining Speed 10 [mm/min.]

<Comparison with Other Manufacturing Method>

(a) Present Invention
Composition of Parts: 2 pieces (cylindrical body+disk)
Thickness of Plate Member (drop portion): about 2.5 [mm]
Weight of Wheel: about 1450 [g]

(b) Spinning
Composition of Parts: 2 pieces
Thickness of Plate Member: about 3.0 [mm]
Weight of Wheel: about 1850 [g]

(c) Pressing
Composition of Parts: 3 pieces (two cup-like members+disk)
Thickness of Plate Member: about 2.5 [mm]
Weight of Wheel: about 1550 [g]

Although the invention has been described by way of the exemplary embodiment, it should be understood that those skilled in the art might make many changes and substitutions without departing from the spirit and scope of the invention. It is obvious from the definition of the appended claims that the embodiments with such modifications also belong to the scope of the invention.

What is claimed is:

1. A method for molding a vehicular wheel rim, the method comprising:

electromagnetic molding a cylindrical body having a drop portion and two side portions, the drop portion having a diameter smaller than a diameter of the side portions, by disposing an electromagnetic molding die on the side of an outer periphery of a metallic cylindrical material, the electromagnetic molding die having an inner face which serves as a molding face, disposing an electromagnetic molding coil on the side of an inner periphery of the cylindrical material and by charging electrical energy to the electromagnetic molding coil to enlarge and press the cylindrical material against the molding face of the molding die; and after said electromagnetic molding operation, externally curling edges of the side portions by pressing the edges of the side portions in an axial direction with curling dies while restraining an outer periphery of the drop portion of the cylindrical body with a buckling preventing die, wherein the electromagnetic molding die is used as the buckling preventing die in said curling operation.

2. The method for molding the vehicular wheel rim as set forth in claim 1, wherein the electromagnetic molding die is dividable in an axial direction into a plurality of dies including a center die corresponding to the drop portion and side dies corresponding to the side portions; and wherein the center die is used as the buckling preventing die in said curling operation and external curling is implemented to the side portions by axially pressing the curling dies from both ends of the side portions at the same time in a state in which the side dies are removed.

3. The method for molding the vehicular wheel rim as set forth in claim 2, wherein the cylindrical material is made of aluminum molded by extrusion molding.

4. The method for molding the vehicular wheel rim as set forth in claim 1, wherein the cylindrical material is made of aluminum molded by extrusion molding.

* * * * *